United States Patent [19]

Selinko

[11] 4,111,343

[45] Sep. 5, 1978

[54] RETRACTABLE MOUNTING CLIP ARRANGEMENT FOR MINIATURE PORTABLE APPARATUS OR THE LIKE

[75] Inventor: George Joseph Selinko, Lighthouse Point, Fla.

[73] Assignee: Motorola, Inc., Schaumburg, Ill.

[21] Appl. No.: 790,712

[22] Filed: Apr. 25, 1977

[51] Int. Cl.[2] ..... A45C 11/00

[52] U.S. Cl. ..... 224/5 H; 24/3 H; 24/3 J; 224/26 R

[58] Field of Search ..... 24/3 R, 3 F, 3 G, 3 H, 24/3 J, 3 L, 11 CC, 11 S, 73 LA, 73 SS, 248 R, 259; 206/5 R, 38, 101, 119; 224/5 R, 5 H, 5 V, 2 B–2 F, 26 R, 26 B, 26 D

[56] References Cited

U.S. PATENT DOCUMENTS

| | | | |
|---|---|---|---|
| 1,777,543 | 10/1930 | Bashe et al. | 224/26 D |
| 2,551,515 | 5/1951 | Tschirf | 24/3 L X |
| 3,631,994 | 1/1972 | Mackzum, Jr. | 224/5 H X |

*Primary Examiner*—Stephen G. Kunin

*Attorney, Agent, or Firm*—Donald B. Southard; James W. Gillman

[57] ABSTRACT

A retractable mounting clip arrangement is provided for use with miniaturized, hand-held apparatus intended to be worn on the person of the user such as on a belt or in the shirt pocket. The clip arrangement includes a curved base plate assembly designed to position with a corresponding curved recess in the apparatus housing. A mounting clip, preferably formed of a thin steel strip is pivotably hinged to the base plate. The base plate is made to slide within the curved recess so that in one position the mounting clip is substantially flush with the surface of the housing and in still another slidable position the mounting clip is positioned entirely above the housing surface and operable to clamp onto a shirt pocket or belt.

5 Claims, 3 Drawing Figures

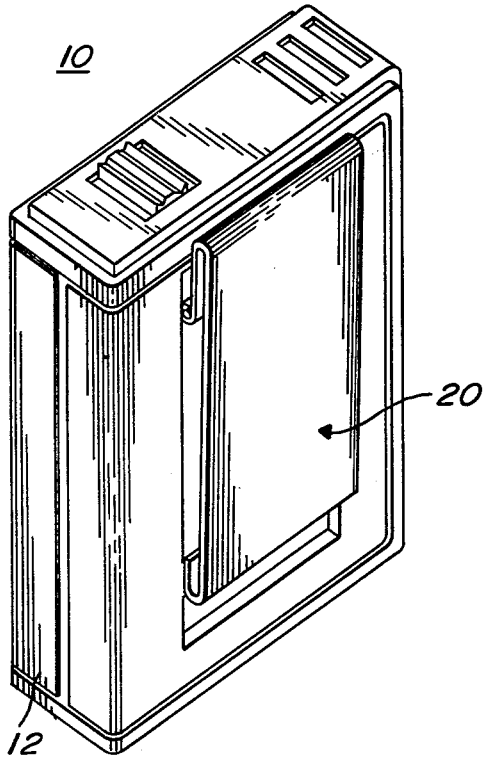
Fig. 1
Fig. 2
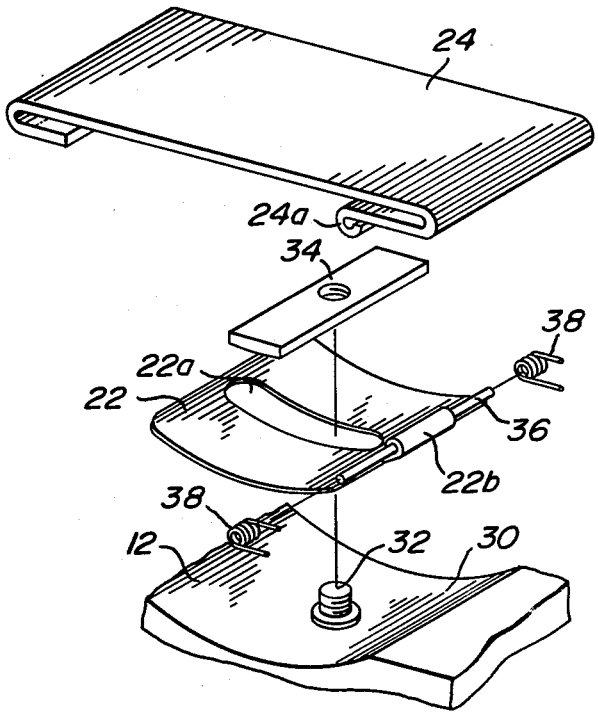
Fig. 3
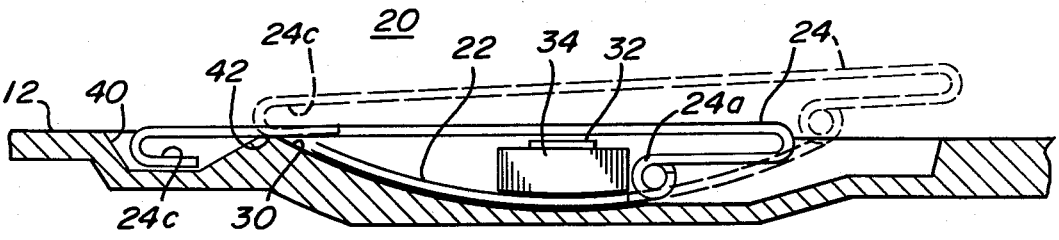

RETRACTABLE MOUNTING CLIP ARRANGEMENT FOR MINIATURE PORTABLE APPARATUS OR THE LIKE

BACKGROUND OF THE INVENTION

The present invention relates generally to mounting clips and, more particularly, to a fully retractable mounting clip arrangement especially suited for use with personalized radio receivers which may be readily and conveniently retracted to a position flush with the surface of the apparatus housing.

Personalized radio apparatus and other devices of this character are intended to be worn on the belt or carried in a shirt pocket of the user. This requires a mounting clip arrangement of some sort whereby the portable apparatus can be securely attached to the belt or shirt pocket so as to avoid damage by inadvertent droppage or the like.

However, in some instances, the clip arrangement actually used is of a substantial bulk when compared to the radio housing itself and can cause a number of undesirable problems. For example, in servicing or maintenance operations, the clip assembly can become snagged in test leads of monitoring equipment or in other materials in close proximity. Then too, it creates a problem for battery charging equipment in that the entrance opening thereto is of a more complicated configuration than the otherwise rather simple rectangular opening if no clip assembly were included or protruding on the radio apparatus. In any event, with the size of the miniaturized or personal radio apparatus decreasing substantially in recent years, the size of the mounting clip becomes more and more prominent and, in many instances, less desirable.

SUMMARY OF THE INVENTION

Accordingly, it is an object of the present invention to provide a completely retractable mounting clip arrangement for personalized radio apparatus or the like.

A more particular object of the present invention is to provide a mounting clip arrangement of the foregoing type which is fully retractable between a position where the mounting clip is above the housing surface to a position completely flush with the housing surface.

In practicing the invention, a retractable mounting clip arrangement is provided for use with associated miniaturized radio receiver or other portable apparatus, which mounting clip arrangement included a curved base plate which is adapted for slidable retention within a corresponding recess provided in the housing surface of the miniaturized apparatus. A thin but sturdy mounting clip is secured to the base plate by a hinge and lock pin combination. In one slidable position, the mounting clip is fully retractable to a position wherein the mounting slip is substantially flush with the surface of the apparatus housing. In the other slidable position the mounting clip extends above the surface of the housing and is operable to clamp on a user's shirt pocket or belt in the conventional manner.

BRIEF DESCRIPTION OF THE DRAWINGS

The features of the present invention which are believed to be novel are set forth with particularity in the appended claims. The invention, itself, together with further objects and advantages thereof, may best be understood by reference to the accompanying drawings, in which:

FIG. 1 is a view in perspective of a typical personalized radio receiver apparatus which includes a retractable mounting clip, which mounting clip arrangement has been constructed in accordance with the present invention;

FIG. 2 is an enlarged fragmentary and exploded view in perspective of the mounting clip arrangement as shown in FIG. 1 illustrating certain of the component parts thereof; and FIG. 3 is an enlarged cross-sectional view of the mounting clip and curved base plate positioned within a curved recess in the surface of the apparatus housing and illustrating the limits of respective slidable positions therein.

DESCRIPTION OF THE PREFERRED EMBODIMENT

Referring now to the drawings, a radio apparatus 10 is illustrated in FIG. 1 of the personal or miniaturized type customarily intended to be carried by a user on his belt or in a shirt pocket. It is to be understood that the invention is not to be limited to any particular type of portable apparatus and in vact may be made applicable to a wide variety of such apparatus. In any event, a mounting clip arrangement indicated generally at 20 is shown attached to a housing 12 of a portable, miniaturized radio apparatus 10, which clip arrangement 20 has been constructed in accordance with the present invention.

As may be best seen in FIG. 3, the mounting clip arrangement 20 includes a curved base plate 22 and a conventional mounting clip 24 attached thereto at a top hinged portion **24*a* by any suitable means such as a connecting lock or pivot pin. At least one torsion spring 38 is included to provide the required spring bias for clip 24**.

As illustrated, a recess 30 is provided in the surface of the apparatus housing 12 which has a curved or arcuate bottom area which corresponds substantially to that effected for the curved base plate 22. Base plate 22 includes a centrally located elongated slot **22*a* which is dimensioned to overfit an upstanding fastener, such as machine screw 32, extending upwardly from the surface of the housing 12. The base plate 22 is secured to and captivated by the fastener 32 by a guide block 34 which threads onto screw 32 and extends beyond the lateral dimensions of the slot 22*a* and provides a guide surface for the base plate 22 parallel to the arcuate recess surface. Base plate 22 may thus be slidably positioned along a path defined by the slot 22*a*, with the respective ends thereof functioning as stops bearing against the screw 32**.

The base plate 22 includes a hinge member **22*b* at one end therof. Similarly, the mounting clip 24 includes a pair of hinge members 24*a*. Mounting clip 24 and base plate 22 are firmly secured together by a connecting or lock pin 36 inserting through respective hinge members 22*b* and 24*a*. In this manner, mounting clip 24 is rendered pivotable about pin 36 by asserting pressure on the clip area extending beyond the hinge 24*a* in the conventional manner. A pair of torsion springs 38 are carried on the pin 36 and provide a permanent spring bias for mounting clip 24 toward the base plate 22**.

In operation, the base plate 22, to which mounting clip 24 is secured to in the manner previously described, is secured within recess 30 by the mounting bolt 32 and cooperating guide block 34. When finger pressure is exerted on the mounting clip 24 to move it to a position to the left (viewing FIG. 3), the base plate 22 slidably moves to a position where the attached mounting clip 24 is substantially flush with the surface of housing 12. In this position, the forward U-shaped portion 24c of the mounting clip 24 is positioned within a further recess 40. Correspondingly, when finger pressure is exerted on the mounting clip 24 so as to move it to the right (viewing FIG. 3) the curved base plate 22 is slidably moved to a position forcing the hinged end of mounting clip 24 up and outwardly where it is maintained at a position slightly above the surface of the housing 12, as depicted in phantom line in FIG. 3. At the same time, the forward U-shaped portion 24c now rests on a raised portion or ledge 42 at approximately the same height as the overall surface of the apparatus housing 12. This ledge in cooperation with the underside of portion 24c of mounting clip 24 clamps therebetween a part of the shirt pocket or other clothing of the user. When worn on the belt, the U-shaped portion 24c is positioned so as to capture a portion of the belt. The mounting clip 24 is operated in the conventional manner, i.e., pressing downwardly on the hinged portion to the right of locking pin 36 (viewing FIG. 3) which forces the end portion 24c upwardly and outwardly and pivots around the pin 36. Release of the mounting clip then permits the forward portion 24c to move inwardly under the spring bias pressure of the torsion springs 38.

Accordingly, while only a specific embodiment of the present invention is shown and described herein, it will, of course, be understood that other variations and modifications may be effected without departing from the true scope and spirit of the invention itself. The claims as appended hereto are intended to cover all such modifications and alternative constructions that may fall within the true scope and spirit.

Acordingly, what is claimed is:

1. A retractable mounting clip arrangement especially suited for use with portable, hand-held apparatus intended to be worn on a person, including in combination:

a housing a recess provided in a surface of said housing and including an arcuate bottom surface area;

a curved base plate for positioning within said recess and slidable along said arcuate bottom surface of said recess between first and second fixed positions;

an elongated mounting clip pivotably secured to said base plate; and means for slidably securing said curved base plate within said housing recess, said mounting clip being substantially flush with the surface of said housing when said base plate and attached mounting clip is in said first and slidable position, and wherein said mounting clip is at a level above the surface of said housing when said base plate and attached mounting clip is in said second slidable position.

2. A retractable mounting clip arrangement in accordance with claim 1 wherein a mounting post extends upwardly from said bottom of said recess and wherein said base plate includes an elongated slot along the longitudinal axis thereof for overfitting said mounting post.

3. A retractable mounting clip arrangement in accordance with claim 2 wherein said base plate is slidably secured to said mounting post by a fastener threadably received on said mounting post and overlying a portion of said base plate and constituting a guide surface parallel to the arcuate bottom of the recess through which said mounting post extends.

4. A retractable mounting clip arrangement in accordance with claim 1 wherein said base plate and mounting clip include respective hinge portions and wherein said mounting clip is pivotably secured to said base plate by a locking pin insertable within said hinge portions thereof.

5. A retractable mounting clip arrangement in accordance with claim 4 wherein at least one torsion spring is mounted on said locking pin to provide a set spring bias for said mounting clip.

* * * * *